US007815748B2

(12) United States Patent
Delaney et al.

(10) Patent No.: US 7,815,748 B2
(45) Date of Patent: Oct. 19, 2010

(54) APPARATUS FOR CLEANING STACKED VESSELS WITH LOW HEAD CLEARANCE

(75) Inventors: Robert E. Delaney, Kennett Square, PA (US); Andrew K. Delaney, West Chester, PA (US); Bentley F. Gleeson, Plymouth Meeting, PA (US); Minh Q. Le, Fairfax, VA (US)

(73) Assignee: Gamajet Cleaning Systems, Inc., Exton, PA (US)

( * ) Notice: Subject to any disclaimer, the term of this patent is extended or adjusted under 35 U.S.C. 154(b) by 738 days.

(21) Appl. No.: 11/818,732

(22) Filed: Jun. 15, 2007

(65) Prior Publication Data

US 2008/0308135 A1 Dec. 18, 2008

(51) Int. Cl.
*B08B 9/00* (2006.01)

(52) U.S. Cl. ..... 134/167 R; 134/166 R

(58) Field of Classification Search ..... None
See application file for complete search history.

(56) References Cited

U.S. PATENT DOCUMENTS

| | | | | |
|---|---|---|---|---|
| 3,326,468 | A | 6/1967 | Bristow et al. | |
| 3,637,138 | A | 1/1972 | Rucker | |
| 3,791,393 | A | 2/1974 | Baldwin | |
| 3,834,625 | A * | 9/1974 | Barthod-Malat | 239/227 |
| 4,214,705 | A | 7/1980 | Watts et al. | |
| 4,664,720 | A | 5/1987 | Rucker | |
| 5,012,976 | A | 5/1991 | Loberg | |
| 5,076,307 | A | 12/1991 | Harrington | |
| 5,096,122 | A | 3/1992 | Abramoska | |
| 5,133,484 | A * | 7/1992 | Globert et al. | 222/376 |
| 5,169,069 | A | 12/1992 | Rucker et al. | |
| 5,172,710 | A | 12/1992 | Harrington | |
| 5,316,218 | A | 5/1994 | Bowen | |
| 5,332,155 | A | 7/1994 | Jager | |
| 5,640,983 | A | 6/1997 | Sherman, Jr. et al. | |
| 5,947,387 | A | 9/1999 | Zink et al. | |
| 5,954,271 | A | 9/1999 | Le | |
| 6,123,271 | A | 9/2000 | Delaney et al. | |
| 6,561,199 | B2 | 5/2003 | Gleeson et al. | |
| 2003/0015603 | A1 | 1/2003 | Schreur et al. | |
| 2004/0020001 | A1 * | 2/2004 | Lorincz et al. | 15/322 |

OTHER PUBLICATIONS

Gamajet Cleaning Systems, Inc. Sales Brochure (2004).*

* cited by examiner

*Primary Examiner*—Michael Barr
*Assistant Examiner*—Jason Y. Ko
(74) *Attorney, Agent, or Firm*—Michael R. Philips

(57) ABSTRACT

An apparatus for cleaning vessels stacked on racks with a minimum of head clearance. The cleaning apparatus has a drive unit with a turbine wheel connected to a multi-stage gear train. The output motion of the gear train connects through an angular transmission within a fluid conveying elbow to a rotatable housing having a rotatable nozzle angularly assembled thereto. The elbow has a pressure channel and a suction channel there through. The length of the apparatus from the elbow to the housing is short enough to be passed into the bunghole of a vessel, e.g. a wine barrel, while racked. A flexible suction hose is connected to a suction line in the apparatus for removing spent cleaning fluid from within the vessel.

20 Claims, 4 Drawing Sheets

APPARATUS FOR CLEANING STACKED VESSELS WITH LOW HEAD CLEARANCE

FIELD OF THE INVENTION

The present invention relates to the field of cleaning the interior of a vessel, and more particularly to cleaning stacked vessels having restricted head clearance.

BACKGROUND OF THE INVENTION

As used in the description below, the term vessel refers generally to tanks, barrels and other industrial containers that are used to contain liquids in repetitive production cycles. Wine in particular is processed in barrels, preferably oak barrels for best taste and body. Wine barrels are generally stored in horizontal orientation on racks in order to conserve floor space. The head space from the top of a lower barrel to the bottom of an upper barrel stacked on a rack is typically no greater than 20 cm (8.0 inches). The barrel has a single opening known as a bunghole in the middle of the curved sidewall. During the wine production process, samples of wine are periodically extracted through the bunghole and additives are inserted to conform the batch being processed to the desired final characteristics. The bunghole is sealed with a bung, a type of cork, after the sampling and additive procedure has been completed.

A residue of the grapes and additives will remain in the oak barrel after the wine is fermented and the completed wine has been bottled. This residue must be cleaned before the barrel is used again. This cleaning process helps the purity of future wine batches and extends barrel life. Before the present invention, cleaning of wine barrels and other vessels required removing the vessel from the rack. An earlier process for barrel cleaning involved inverting the barrel to position the bunghole at the bottom and inserting a controlled spray device, for example a Gamajet® EZ-7 barrel washer, into the bunghole; the surplus cleaning fluid continuously drained out of the downward-facing bunghole by gravity. This method has the drawback of having to remove the barrels from their storage racks and inverting them for cleaning, requiring additional labor and a dedicated floor area. In addition, this prior method causes flooding of the area below and around the barrel being cleaned with the spent cleaning fluid that carries grape and additive residue.

A significantly improved washer apparatus and method is disclosed in U.S. patent application Ser. No. 11/089,085 filed Mar. 24, 2005 and entitled VESSEL CLEANING DEVICE by the present inventors. This prior invention is known commercially as the Gamajet® All-In-One barrel cleaning machine. Patent application Ser. No. 11/089,085 is incorporated herein by reference. The All-In-One machine disclosed therein incorporates a pressurized fluid passage for injecting fresh cleaning fluid into the barrel and a suction passage for simultaneously removing the spent cleaning fluid from the barrel. This improvement allows the barrel to be cleaned in the normal position with the bunghole facing up. The All-In-One machine is formed as an elongate linear structure. The fresh cleaning fluid is discharged from a spray nozzle disposed within the barrel to impinge the interior surfaces of the barrel. The suction line passes through the drive body and the rotating nozzle structure to a tube that is positioned within the barrel or other vessel being cleaned. This All-In-One cleaning machine eliminates the area flooding described above with relation to the EZ-7 machine by extracting the spent cleaning fluid from the vessel being cleaned. However, a particular limiting requirement of the All-In-One machine is that with the bunghole facing up, a considerable clearance over the top of the barrel is needed for insertion and extraction of the elongate cleaning mechanism. This clearance distance typically requires that the barrels must be removed from their multi-level rack storage for cleaning, a time-consuming task. Furthermore, barrel moving involves a risk of barrel damage or injury to personnel. It is more desirable to clean barrels while on their storage racks, thus saving time and floor space as well as being a safer procedure.

SUMMARY OF THE INVENTION

The present invention overcomes the drawbacks of the prior known apparatus and methods, improving the process of barrel cleaning. The invention provides a cleaning apparatus capable of being introduced through a bunghole in a barrel that is stacked with a low head clearance. The cleaning apparatus has a drive unit that generates a torque from a pressurized fluid flow over a turbine wheel connected to a multi-stage gear train adapted for low speed output. An output shaft from the gear train is coupled to a first bevel gear that is in drive communication with a second bevel gear that is perpendicular to the first bevel gear, both bevel gears contained within an elbow enclosure. The second bevel gear drives a rotating unit having a perpendicular rotating nozzle that resides within the barrel. A first fluid passage conveys the cleaning fluid through the gear train mechanism and the rotating unit to the nozzle. A second fluid passage conveys spent cleaning fluid from the barrel to be discharged as waste. A flexible suction hose is connected to the cleaning apparatus. The length from the elbow to the rotating housing is relatively short to enable inserting the flexible suction hose and rotating housing into a barrel for cleaning the interior thereof.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figures 1, 2:
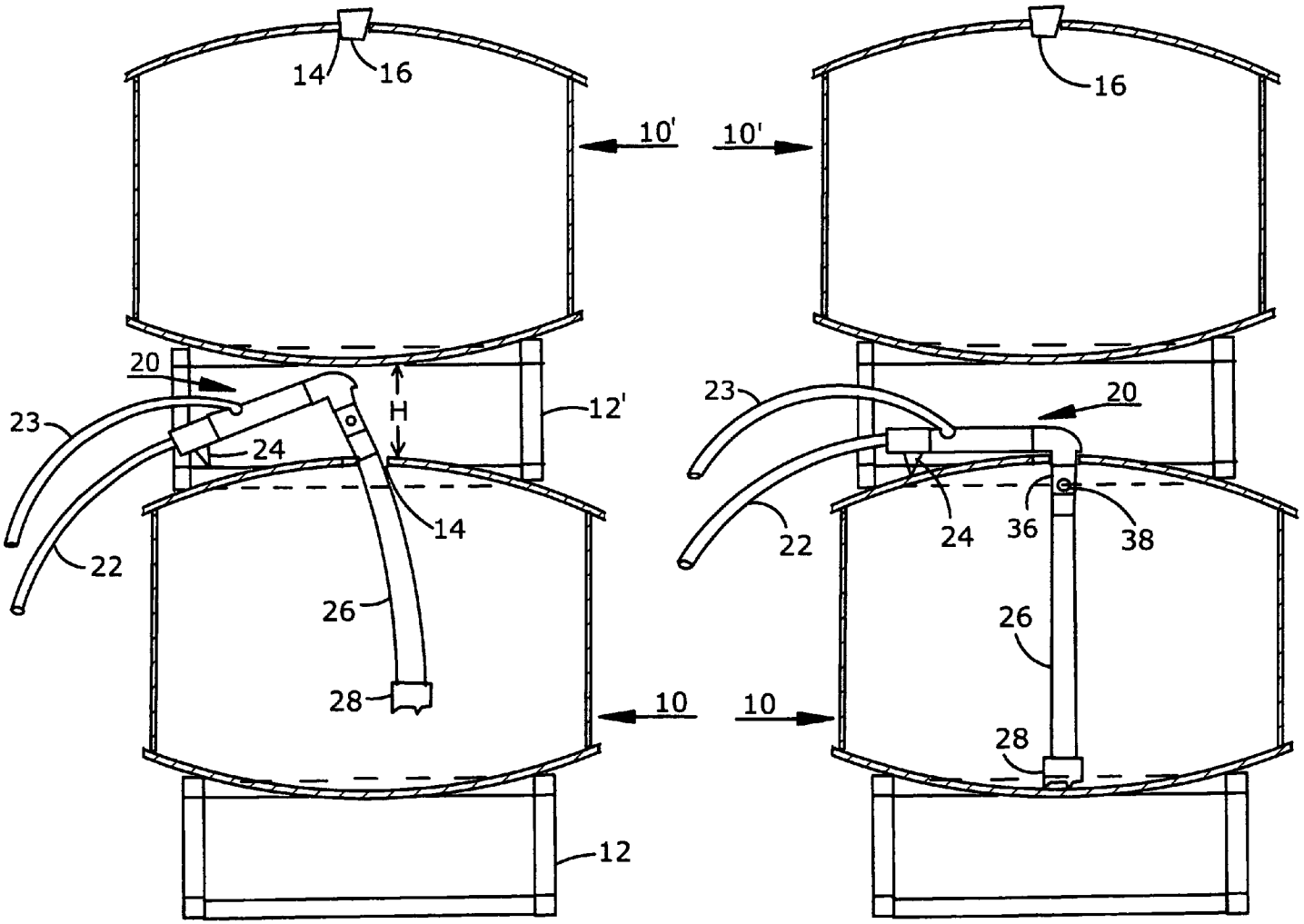
FIG. 1 is a schematic cross sectional view of two containers on supporting racks with the cleaning apparatus of the present invention being inserted into the lower container.
FIG. 2 is the view of FIG. 1 after the cleaning apparatus has been fully inserted into the lower container.

Referring now to FIG. 1, the invention cleaning apparatus 20 is illustrated as it is being inserted through an aperture 14 in the top of a vessel 10. Vessel 10 is supported on a first rack 12 with a second rack 12' positioned on top of first vessel 10 and a second vessel 10' positioned on second rack 12'. Whereas second vessel 10' is not being accessed for cleaning in the instant illustrated, a closure 16 is placed in aperture 14. In the particular case of vessels 10, 10' being for example wine barrels, racks 12, 12' are configured to maintain a minimal head space H between the top of first vessel 10 and the bottom of second vessel 10'. In practice, head space H is made sufficient to permit wine processing personnel to extract a sample of the contents of first vessel 10 and insert a modifying additive through aperture 14. Wine processing terminology defines aperture 14 as a bunghole and closure 16 as a bung. Head space H is commonly not more than 20 cm (8.0 inches), thus preventing the insertion of a barrel cleaning device having a longer linear section such as is disclosed in the patent application incorporated herein. Whereas cleaning apparatus 20 of the present invention is formed with an elbow connection between proximal and distal portions, the linear length for insertion into vessel 10 is significantly less and the barrel head space condition is substantially overcome. A flexible suction hose 26 is attached to the distal end of cleaning apparatus 20, enabling entry through aperture 14 and further overcoming the head space condition. An annular weighted foot 28 is mounted to the lower end of suction hose 26 to assist in insertion of hose 26 into vessel 10. A supply hose 22 is connected to the proximal end of cleaning apparatus 20 for providing a flow of pressurized cleaning fluid. A discharge hose 23 is connected to an intermediate port in cleaning apparatus 20 for removing spent cleaning fluid. A foot 24 is attached to the proximal end of cleaning apparatus 20 to enable cleaning apparatus 20 to reside in the desired orientation as described below.

Referring now to FIG. 2, cleaning apparatus 20 is shown fully mounted to vessel 10 with foot 24 resting on the curved upper surface of vessel 10, allowing cleaning apparatus 20 to reside with the proximal end thereof oriented horizontally and suction hose 26 extending vertically down to the bottom of vessel 10, aided by weighted foot 28. Rotating housing 36 and nozzle 38 are positioned within vessel 10 for delivering a rotating stream of impinging cleaning fluid to all interior surfaces. Suction hose 26 is positioned to draw off the spent cleaning fluid at the bottom through discharge hose 23 to a vacuum device (not shown) that discharges to waste.

Figure 4:
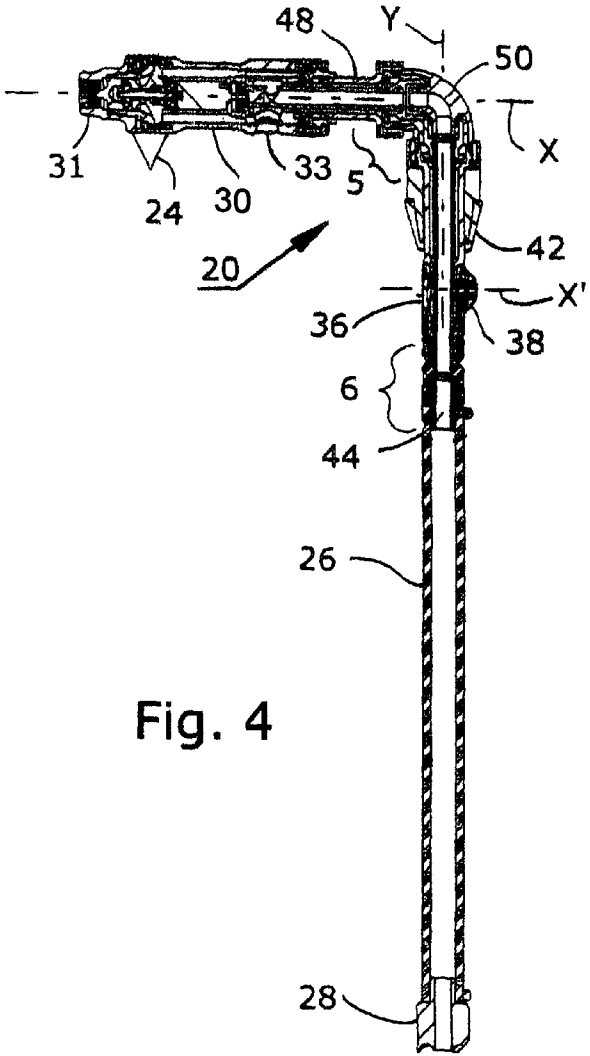
FIG. 4 is a cross sectional view of the cleaning apparatus illustrated in FIG. 3.
Figure 3:
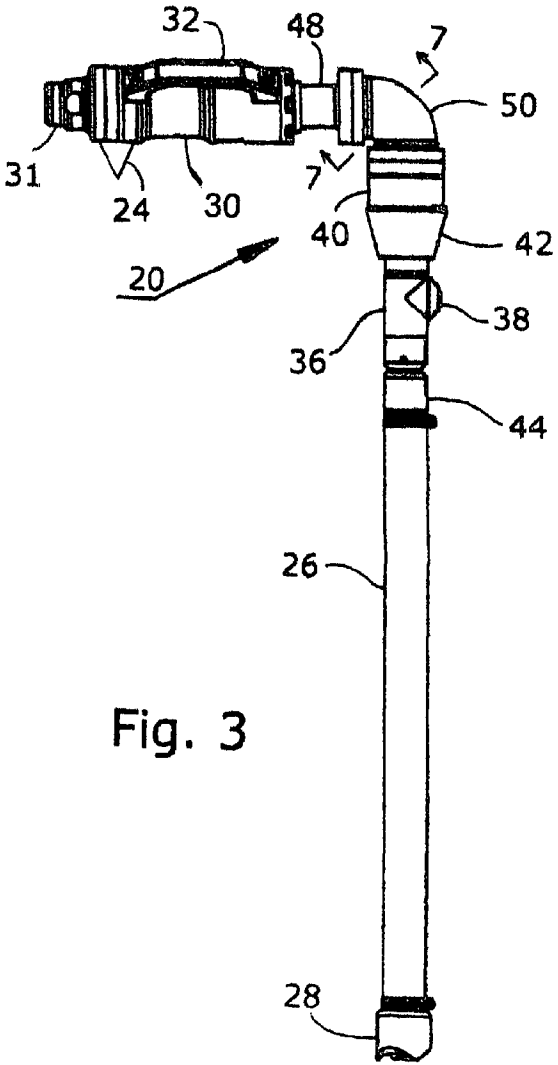
FIG. 3 is a side elevation view of the cleaning apparatus of the invention.

FIG. 3 and FIG. 4 show an exterior side elevation view and a cross sectional view respectively of barrel cleaning apparatus 20. A drive unit 30 comprises a turbine wheel that is driven by a flow of pressurized cleaning fluid, the turbine wheel being connected to a multi-stage speed reduction gear train. A handle 32 is provided on drive unit 30 for use in inserting and removing cleaning apparatus 20 to and from vessel 10 (see FIG. 1). Hose connection 31 provides an entry for pressurized cleaning fluid from supply hose 22 (see FIG. 2). Outlet port 33 provides an exit for spent cleaning fluid and residue from within the vessel being cleaned. Outlet port 33 is in fluid connection with a suction channel within elbow 50 as will be described below. An output shaft from the gear train in drive unit 30 passes through transition section 48 that is connected to an elbow 50. Elbow 50 may be at any desired angle; according to the preferred embodiment of the invention elbow 50 is a 90° elbow. A rotating housing 36, alternately referred to as a T housing, is connected to elbow 50 through a sleeve 40 formed with a bunghole fitting 42. Drive unit 30 generates a torque about axis X in response to passage of the cleaning fluid therethrough. The generated torque is transmitted to rotating housing 36, causing rotating housing 36 to rotate about axis Y. The direction of rotation of housing 36 and other rotating components of the invention may be either clockwise or counterclockwise, depending on the preference of the designer. Rotating housing 36 will rotate about axis Y and nozzle 38 will rotate about axis X' to cause an impinging spray of cleaning fluid to radiate within the vessel through 360° for thoroughly cleaning the interior surface of the vessel. According to the present invention, axis X' of nozzle 38 is substantially parallel to and spaced apart from axis X of drive unit 30.

Suction hose 26 is formed of a flexible material, e.g. vinyl, to enable repeated bending and straightening while being inserted into and removed from vessel 10 (see FIG. 1). Weighted foot 28 prevents suction hose 26 from rotating and swivel connector 44 allows suction hose 26 to remain still while housing 36 rotates. Weighted foot 28 is formed with an irregular lower portion configured as an array of prongs, or scallops, that will contact the inner surface of the vessel for holding suction hose 26 from rotating while allowing the entry of spent cleaning fluid to suction hose 26. Suction hose 26 is connected to rotating housing 36 through a swivel connector 44 to allow relative rotation therebetween. Details of the drive mechanism and cleaning fluid transition through elbow 50 are described below.

Figure 5:
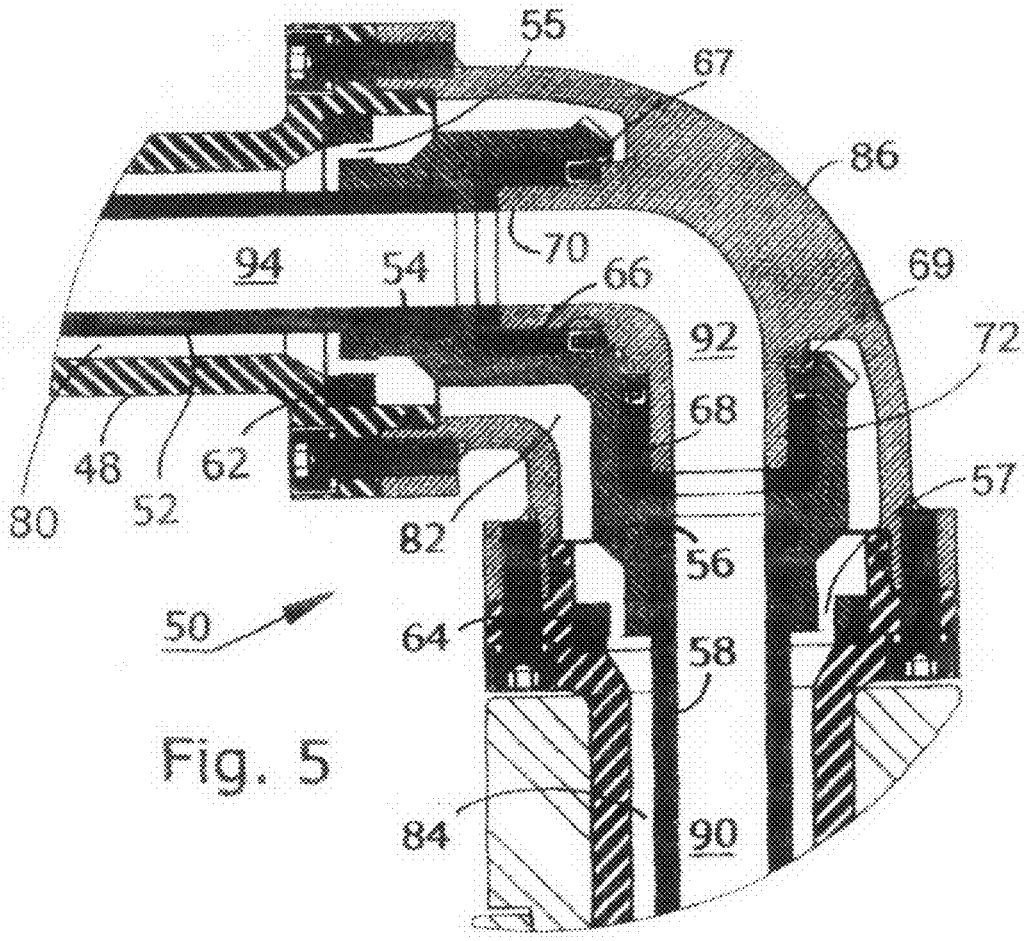
FIG. 5 is an enlarged view of the cross section in the area indicated by bracket 5 of FIG. 4.

Referring now to FIG. 5, an enlarged cross section of elbow 50 is shown in the area indicated by bracket 5 of FIG. 4. Elbow 50 is a compound elbow having an annular pressure channel 82 and a central suction channel 92 supported by a web 86 to be substantially concentric with one another. A hollow drive tube 52 passes through transition section 48, the left end (not shown in this view) being drivingly connected to the gear train within drive unit 30 (see FIG. 4). A drive bevel gear 54 is affixed to drive tube 52 to rotate therewith. Drive bevel gear 54 is meshed in drive communication with driven bevel gear 56, oriented at an angle thereto, preferably an angle of 90°. Driven bevel gear 56 is affixed to a driven tube 58 to rotate therewith. The combination of drive bevel gear 54 and driven bevel gear 56 thus provides an angular transmission means. A suction channel 94 within drive tube 52 is in fluid communication through suction channel 92 of elbow 50 to the suction channel 90 of driven tube 58. The lower end of driven tube 58 is connected to rotating housing 36 (see FIG. 4) to cause housing 36 to rotate around vertical axis Y. A further angular gear transition (not shown) is provided from driven tube 58 to nozzle 38 (see FIG. 4) within rotating housing 36 to cause nozzle 38 to rotate around horizontal axis X'. Nozzle 38 is formed with a plurality of angularly spaced apart ports that may be flush with or protrude from the surface of nozzle 38. Thus, when drive unit 30 causes drive tube 52 to rotate around horizontal axis X, nozzle 38 rotates around horizontal axis X'.

Referring further to FIG. 5, an annular fluid passage is formed of pressure channels 80, 82, 84 for conducting pressurized cleaning fluid around drive tube 52, around drive bevel gear 54, through elbow 50, around driven bevel gear 56 and around driven tube 58 to be sprayed from rotating nozzle 38 (see FIG. 4). A series of holes 55 are provided through the flange of drive bevel gear 54 in a circular array to pass pressurized cleaning fluid from pressure channel 80 to pressure channel 82. A series of holes 57 are provided through the flange of driven bevel gear 56 in a circular array to pass pressurized cleaning fluid from pressure channel 82 to pressure channel 84. A fluid suction passage is formed of channels 90, 92, 94 for conducting spent cleaning fluid and collected residue through the center of driven tube 58, driven bevel gear 56, elbow 50, drive bevel gear 54 and drive tube 52. Suction channel 94 connects to discharge port 33 (see FIG. 4) of drive unit 30. A bearing 62 is mounted in transition section 48 to support the flange of drive bevel gear 54 for rotation and a second bearing 66 is positioned between drive bevel gear 54 and a mating protrusion 70 within elbow 50. A liquid seal 67 is assembled between protrusion 70 and drive bevel gear 54 to prevent pressurized cleaning fluid in pressure channels 80, 82, 84 from mixing with spent cleaning fluid in suction channels 90, 92, 94. A bearing 64 is mounted to support the flange of driven bevel gear 56 for rotation and a second bearing 68 is positioned between driven bevel gear 56 and a mating protrusion 72 within elbow 50. A liquid seal 69 is assembled between protrusion 72 and driven bevel gear 56 to further prevent pressurized cleaning fluid in pressure channel 80, 82, 84 from mixing with spent cleaning fluid in suction channel 90, 92, 94. Liquid seals 67 and 69 are of the type known as dynamic seals, having an internal leaf spring structure to press edges of the seals against mating surfaces to enhance seal integrity.

Figure 6:
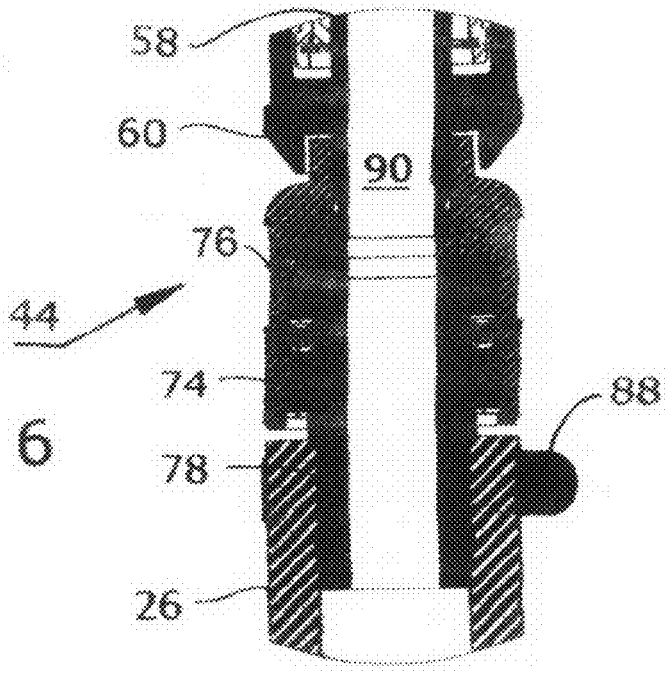
FIG. 6 is an enlarged view of the cross section in the area indicated by bracket 6 of FIG. 4.

Referring now to FIG. 6, an enlarged cross section is shown as indicated by bracket 6 of FIG. 4. FIG. 6 generally shows details of swivel connector 44 mounted between driven tube 58 and suction hose 26. Swivel connector 44 is connected by means of an upper collar 60 to the lower end of driven tube 58. A nipple 78 is held rotatably within swivel connector 44 by a collar 74 and seal 76. Suction hose 26 is mounted to the lower end of nipple 78 by compression band 88. In operation, as driven tube 58 is rotated by the motion of rotating housing 36 (see FIG. 4), upper collar 60 rotates. With the pronged end of weighted foot 28 being in contact with the interior surface of the vessel being cleaned, suction hose 26 is restrained from rotating. Swivel connector 44 allows this relative motion between rotating driven tube 58 and stationary suction hose 26 without creating a meaningful torque therebetween.

Figure 7:
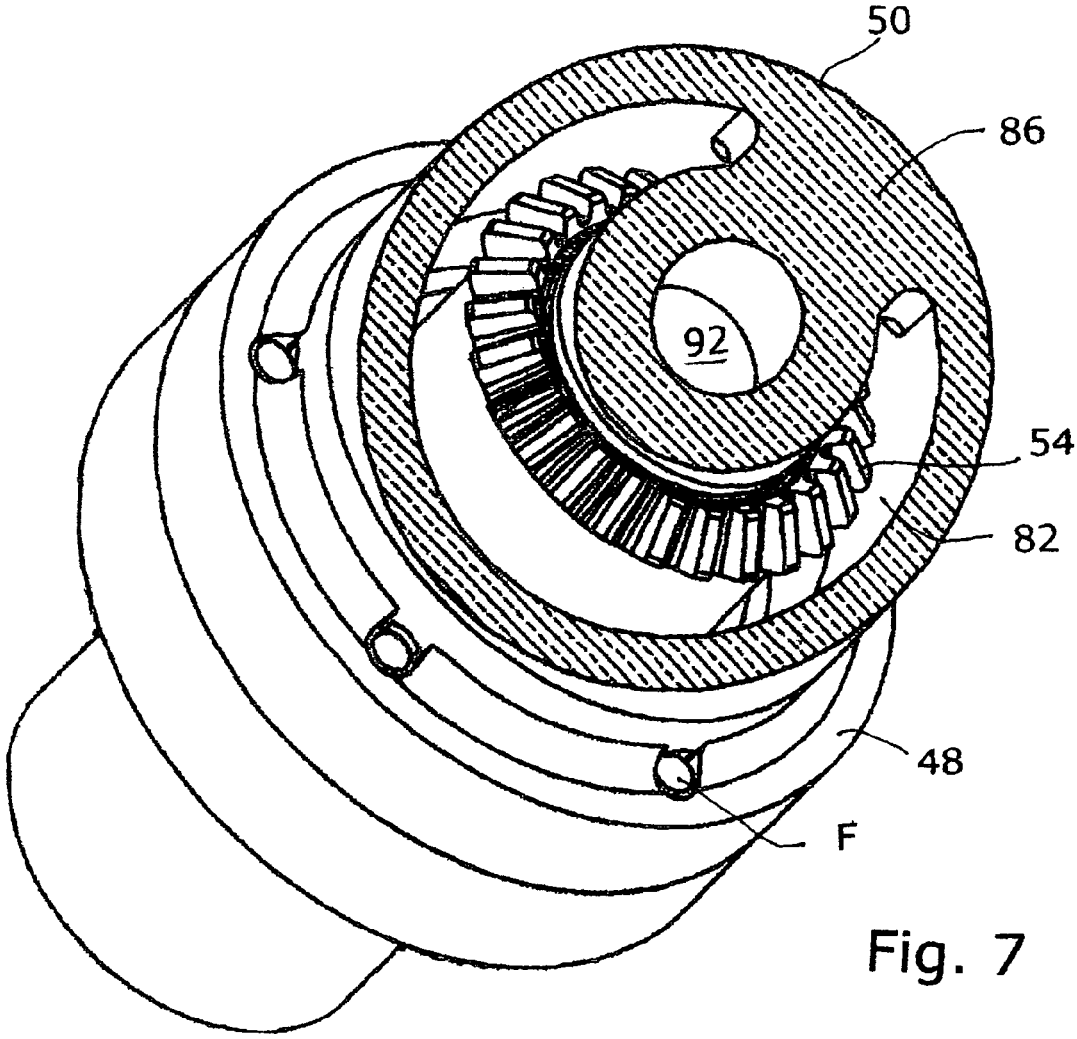
FIG. 7 is a cross sectional view taken in the direction of line 7-7 of FIG. 3.

Referring now to FIG. 7, a cross section of elbow 50 is illustrated in the direction of line 7-7 of FIG. 3. As shown, annular pressure channel 82 in elbow 50 partly encircles suction channel 92 that is maintained affixed to the outer wall of elbow 50 in a substantially concentric relation by web 86. Drive bevel gear 54 is rotatably mounted within elbow 50. Elbow 50 is assembled to transition section 48 by a number of fasteners F, e.g. screws. In the preferred embodiment of the invention, the minimal cross sectional area of pressure channel 82, extended through pressure channels 80, 84 (see FIG. 5) is approximately equal to or less than the minimal cross sectional area of suction channel 92, extended through suction channels 90, 94. In this manner, the suction process will be capable of removing the volume of spent cleaning fluid from the vessel being cleaned.

While the description above discloses preferred embodiments of the present invention, it is contemplated that numerous variations and modifications of the invention are possible and are considered to be within the scope of the claims that follow.

What is claimed is:

1. An apparatus for cleaning the interior of stacked vessels with low head clearance by discharging a cleaning fluid, the apparatus comprising:

a. a drive unit oriented along a first axis and rotatable in response to passage of a cleaning fluid therethrough;

b. a hollow drive tube connected at a first end for being rotated by the drive unit, the hollow drive tube formed for transmitting fluid;

c. a compound elbow having a first fluid transmitting channel and a second fluid transmitting channel, the first and second channels being isolated from one another;

d. angular drive transmission means mounted rotatably within the compound elbow and connected to a second end of the hollow drive tube for being rotated thereby, whereas the fluid flows through the angular drive transmission means;

e. a hollow driven tube connected at a first end for being rotated by the angular transmission means, the hollow driven tube formed for transmitting fluid;

f. wherein the drive tube and the driven tube are in fluid communication with the first fluid transmitting channel within the elbow; and g. a rotatable housing oriented along a second axis that is at an angle to the first axis, the rotatable housing being in drive communication with a second end of the driven tube.

2. The apparatus described in claim 1, further comprising a rotatable nozzle assembled to the rotatable housing and oriented along a third axis that is substantially parallel to the first axis.

3. The apparatus described in claim 1, wherein the angle between the first and second axes is substantially 90°.

4. The apparatus described in claim 1, wherein the first and second fluid transmitting channels of the compound elbow are substantially concentric.

5. The apparatus described in claim 1, further comprising a flexible hose connected to be in fluid communication with the first channel.

6. The apparatus described in claim 5, further comprising a weighted foot mounted to a lower portion of the flexible hose.

7. The apparatus described in claim 6, wherein the weighted foot is formed with a plurality of prongs located and configured for engaging an inner surface of the vessel.

8. The apparatus described in claim 5, further comprising a swivel connector mounted between the flexible hose and the second channel of the housing for permitting the housing to rotate while the hose remains stationary.

9. An apparatus for cleaning the interior of stacked vessels with low head clearance, comprising:

a. a fluid activated drive unit rotatable around a first axis;

b. a first shaft connected on a first end to the drive unit;

c. a compound elbow having a first fluid passage and a second fluid passage;

d. an angular drive transmission disposed within the compound elbow;

e. a rotatable housing oriented for rotation around a second axis at an angle to the first axis and having a rotatable nozzle oriented around a third axis that is at an angle to the second axis, the third axis residing substantially parallel to the first axis;

f. a second shaft connected on a first end to the angular drive transmission and on a second end to the rotatable housing;

g. fluid transmission means in fluid communication with the first fluid passage of the elbow to convey spent cleaning fluid out of the vessel being cleaned; and h. wherein when the fluid activated drive unit causes the first shaft to rotate around the first axis, the housing rotates around the second axis and the nozzle rotates around the third axis for discharging the fluid for cleaning a vessel.

10. The apparatus described in claim 9 wherein the first and second fluid passages are substantially concentric.

11. The apparatus described in claim 9, wherein the angle between the first and second axes is substantially 90°.

12. The apparatus described in claim 9, wherein the angular transmission comprises a pair of mating bevel gears.

13. The apparatus described in claim 9, further comprising a flexible hose connected to be in fluid communication with the fluid transmission means.

14. The apparatus described in claim 13, further comprising a weighted foot mounted to a lower end of the flexible hose.

15. The apparatus described in claim 14, wherein the weighted foot is formed with a plurality of prongs located and configured for engaging an inner surface of the vessel being cleaned.

16. The apparatus described in claim 13, further comprising a swivel connector mounted between the flexible hose and the rotating housing for permitting the rotating housing to rotate while the flexible hose remains stationary.

17. The apparatus described in claim 1, wherein the angular drive transmission means comprises a pair of mating bevel gears.

18. The apparatus described in claim 1, wherein the compound elbow is configured to receive and support the angular drive transmission means therewithin.

19. The apparatus described in claim 9, wherein the first shaft and the second shaft are each formed with a passage therethrough.

20. The apparatus described in claim 9, wherein the compound elbow is configured to receive and support the angular drive transmission means therewithin.

* * * * *